US007872577B2

(12) United States Patent
Frolov

(10) Patent No.: US 7,872,577 B2
(45) Date of Patent: Jan. 18, 2011

(54) LOCK INPUT DEVICE FOR A SECURITY SYSTEM

(75) Inventor: George Frolov, Farmington, CT (US)

(73) Assignee: Harrow Products LLC, Montvale, NJ (US)

( * ) Notice: Subject to any disclaimer, the term of this patent is extended or adjusted under 35 U.S.C. 154(b) by 583 days.

(21) Appl. No.: 11/664,760

(22) PCT Filed: Oct. 5, 2005

(86) PCT No.: PCT/US2005/035746

§ 371 (c)(1),
(2), (4) Date: Apr. 14, 2008

(87) PCT Pub. No.: WO2006/041873

PCT Pub. Date: Apr. 20, 2006

(65) Prior Publication Data

US 2009/0027197 A1 Jan. 29, 2009

Related U.S. Application Data

(60) Provisional application No. 60/616,030, filed on Oct. 5, 2004.

(51) Int. Cl.
*E05B 45/06* (2006.01)

(52) U.S. Cl. ..... 340/542; 340/540; 340/5.32

(58) Field of Classification Search ..... 340/540, 340/541, 542, 426.15, 426.36, 5.32, 5.62; 70/107, 257, 278.1, 278.7; 292/144, 162, 292/165

See application file for complete search history.

(56) References Cited

U.S. PATENT DOCUMENTS

| | | | | |
|---|---|---|---|---|
| 4,917,022 | A | 4/1990 | Ogasawara et al. | |
| 5,541,585 | A | 7/1996 | Duhame et al. | |
| 5,852,944 | A * | 12/1998 | Collard et al. | 70/278.7 |
| 6,032,500 | A * | 3/2000 | Collard et al. | 70/278.1 |
| 6,351,977 | B1 | 3/2002 | Pedroso et al. | |
| 6,539,755 | B1 * | 4/2003 | Bruwer et al. | 70/107 |
| 6,568,726 | B1 * | 5/2003 | Caspi et al. | 292/341.16 |
| 6,703,919 | B2 | 3/2004 | Baset | |

* cited by examiner

*Primary Examiner*—Van T. Trieu
(74) *Attorney, Agent, or Firm*—Michael Best & Friedrich LLP

(57) ABSTRACT

A security system for monitoring a door movably disposed within a frame a lock adjustable between a locked configuration and an unlocked configuration and a lock sensor configured to generate a signal when the lock adjusts to the unlocked configuration. A door sensor is configured to generate a signal when the door displaces with respect to the frame and an alarm device is configured to provide an alarm. A control is coupleable with the lock and door sensors and is switchable between armed and disarmed modes. The control is configured to operate in the armed mode such that the control activates the alarm when the control receives the door sensor signal prior to a receipt of the lock sensor signal. Alternatively, the control switches to the disarmed mode when the control receives the lock sensor signal prior to a receipt of the door sensor signal.

19 Claims, 8 Drawing Sheets

LOCK INPUT DEVICE FOR A SECURITY SYSTEM

RELATED APPLICATIONS

This application is a 371 of PCT/US2005/035746, filed on Oct. 5, 2005, which claims the benefit of U.S. Provisional Application 60/616,030, filed on Oct. 5, 2004.

The present invention relates to security systems, and more specifically to lock assemblies and sensors used with security systems.

Security systems to prevent unauthorized access into businesses and residences are known and typically include a plurality of sensors for detecting opening of doors and windows. The sensors send signals to a security panel that includes a control for operating an alarm device, such as one or more horns or sirens and/or a communication device (e.g., a dialer or modem) for contacting security personnel. Generally, one door is designated as a primary access door into the secured building, so that when an authorized person desires entry into the building, the person must enter through the access door and must enter a predetermined input into the security panel to prevent the control from activating the alarm device. When exiting, authorized personnel typically perform these same steps in reverse.

SUMMARY OF THE INVENTION

In one aspect, the present invention is a lock assembly for a security system for monitoring at least one door and including a control, the door being movably disposed with a frame. The lock assembly comprises a lock adjustable between a first configuration, at which the lock secures the door within the frame, and a second configuration at which the door is displaceable with respect to the frame. A lock sensor is generally disposed on the door and is configured to generate a signal when the lock adjusts from the first configuration to the second configuration and to transmit the signal to the security system control.

In another aspect, the present invention is a security system incorporating the lock assembly. The security system further comprises a door sensor configured to generate a signal when the door displaces with respect to the frame, an alarm device configured to provide an alarm, and a control. The control is coupleable with the lock sensor and with the door sensor and switchable between an armed mode and a disarmed mode. Further, the control is configured to operate in the armed mode such that the control activates the alarm device when the control receives the door sensor signal prior to a receipt of the lock sensor signal. Alternatively, the control switches from the armed mode to the disarmed mode when the control receives the lock sensor signal prior to a receipt of the door sensor signal.

BRIEF DESCRIPTION OF THE SEVERAL VIEWS OF THE DRAWINGS

The foregoing summary, as well as the detailed description of the preferred embodiments of the present invention, will be better understood when read in conjunction with the appended drawings. For the purpose of illustrating the invention, there is shown in the drawings, which are diagrammatic, embodiments that are presently preferred. It should be understood, however, that the present invention is not limited to the precise arrangements and instrumentalities shown. In the drawings.

DETAILED DESCRIPTION OF THE INVENTION

Figure 1:
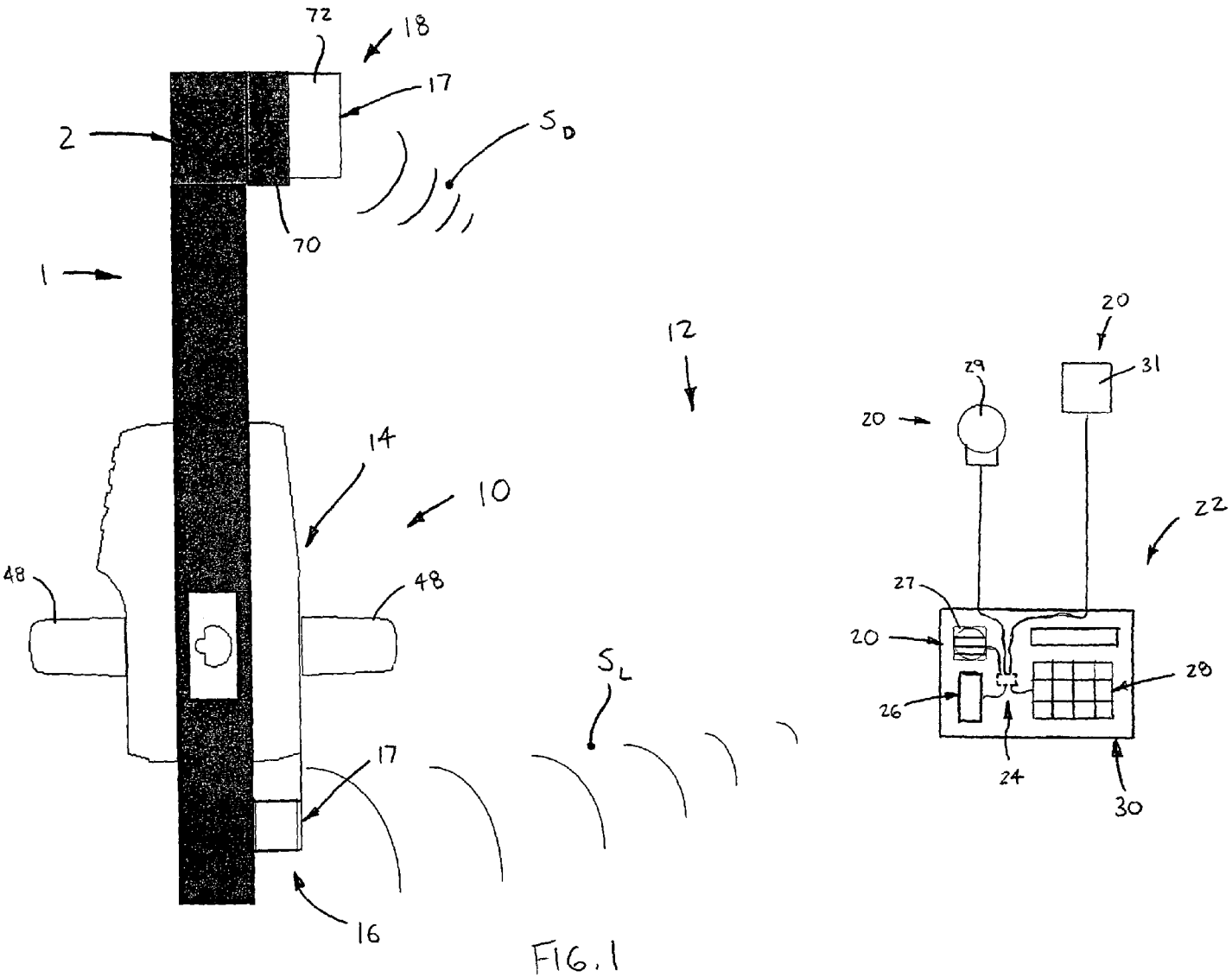
FIG. 1 is an elevational view of a lock assembly and security system in accordance with the present invention.

Certain terminology is used in the following description for convenience only and is not limiting. The words "inner", "inwardly" and "outer", "outwardly" refer to directions toward and away from, respectively, a designated centerline or a geometric center of an element being described, the particular meaning being readily apparent from the context of the description. As used herein, the words "connected" and "coupled" are intended to include direct connections between two members without any other members interposed therebetween, indirect connections between members in which one or more other members are interposed therebetween, and operative connections in which one element, component, device, etc. exerts a force or influence on, or otherwise affects, another element/component without any physical connection. Furthermore, the term "position" is used herein to indicate a position, location, configuration, orientation, etc., of one or more components of the lock assembly and are each depicted in the drawings with reference to a randomly selected point on the element being described. Such points in the drawing figures are randomly selected for convenience only and have no particular relevance to the present invention. The terminology includes the words specifically mentioned above, derivatives thereof, and words of similar import.

Referring now to the drawings in detail, wherein like numbers are used to indicate like elements throughout, there is shown in FIGS. 1-12 a lock assembly 10 for a security system 12 for monitoring at least one door 1 movably disposed within a frame 2, and preferably also additional doors 1 and a plurality of windows (none shown), as discussed below. The lock assembly 10 basically comprises a lock 14 and a lock sensor 16. The lock 14 is adjustable between a first, "locked" configuration (e.g., FIG. 5), at which the lock 14 secures the door 1 within the frame 2, and a second, "unlocked" configuration (e.g., FIG. 6) at which the door 1 is displaceable with respect to the frame 2. The lock sensor 16 is preferably generally disposed on the door 1 and is configured to generate a lock signal $S_L$ when the lock 14 adjusts from the locked configuration to the unlocked configuration.

The security system 12 basically comprises, in addition to the lock assembly 10, a door sensor 18, at least one alarm device 20, and a control 22. The door sensor 18 is configured to generate a door signal $S_D$ when the door 1 displaces with respect to the frame 2 and the alarm device 20 is configured to provide an alarm. Further, the control 22 is coupleable with the lock sensor 16 and with the door sensor 18 and is switchable between an armed mode $M_A$ and a disarmed mode $M_D$. Although the lock assembly 10 and security system 12 are generally described herein and depicted with reference to a door 1, it is within the scope of the present invention to utilize the lock assembly 10 and security system 12 with one or more windows (none depicted). In such cases, the lock 14 functions to releasably secure a window within a window frame (neither shown) and the sensor 18 is configured to sense movement of the window relative to the window frame.

Figure 2:
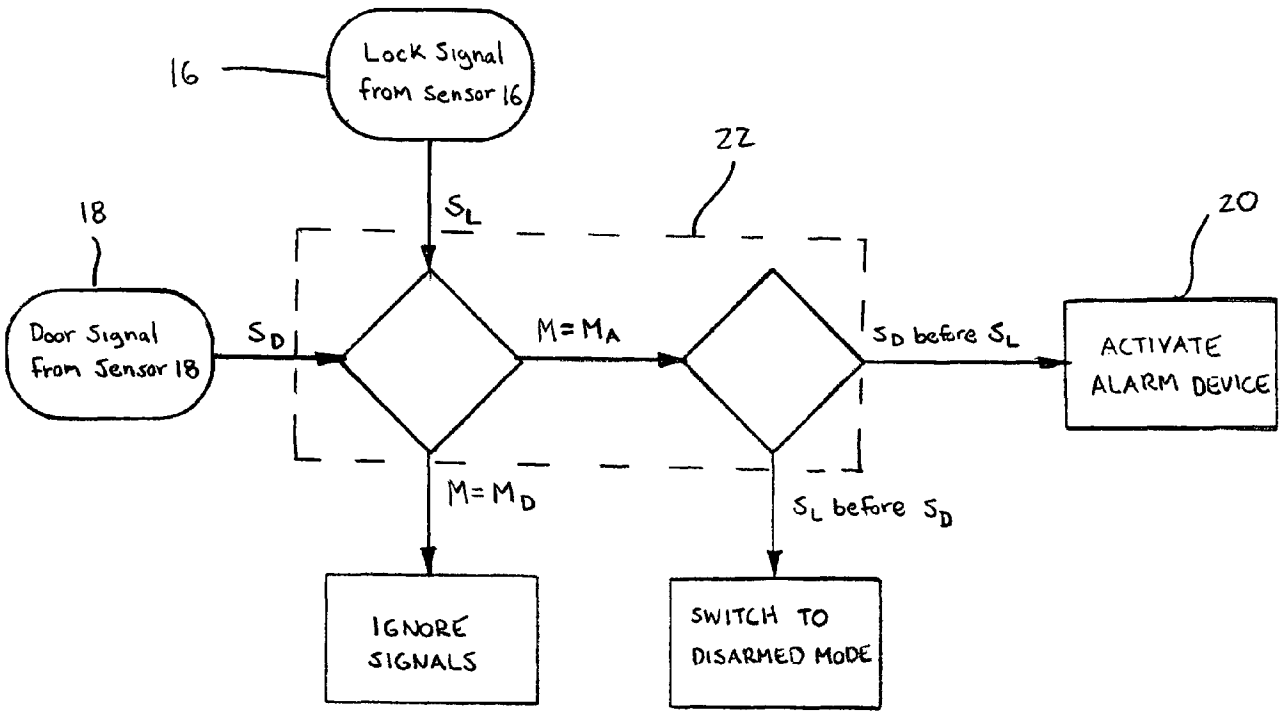
FIG. 2 is a logic diagram of the operation of a control of the security system.
Figure 4:
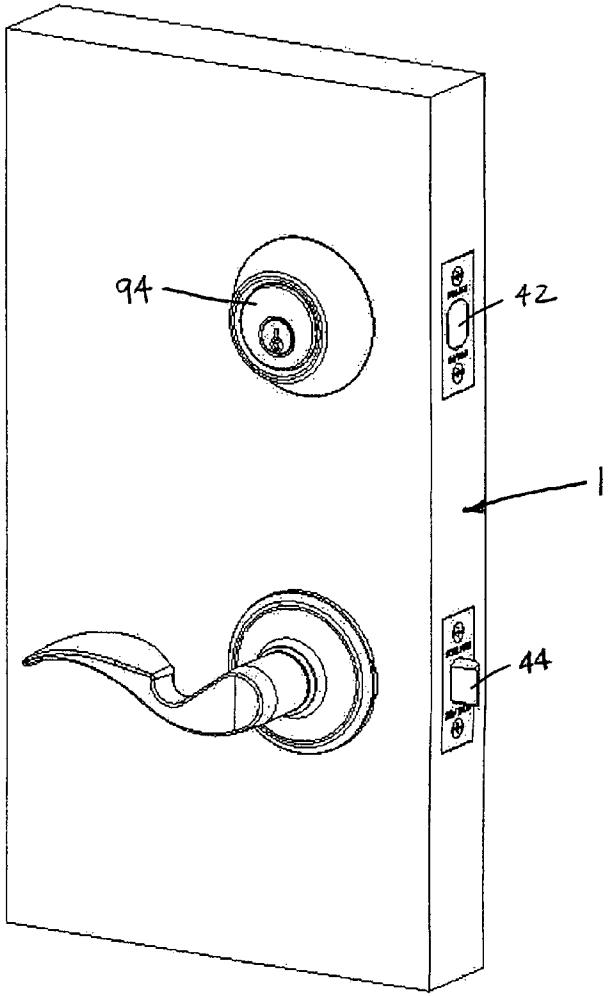
FIG. 4 is a another perspective view of the lock assembly of FIG. 3, showing the outside portion thereof.

As best shown in FIG. 2, the control 22 is configured to operate in the armed mode $M_A$ such that the control 22 activates the alarm device(s) 20 when the control 22 receives the door sensor signal $S_D$ prior to a receipt of the lock sensor signal $S_L$. Alternatively, the control 22 switches to the disarmed mode $M_D$ when the control 22 receives the lock sensor signal $S_L$ prior to a receipt of the door sensor signal $S_D$. In either case, the control 22 either activates the one or more alarm devices 20 when first receiving the door signal $S_D$, or switches to the disarmed mode $M_D$ when first receiving the lock signal $S_L$, regardless of whether or not the other signal $S_L$, $S_D$ is subsequently received by the control 22 after taking the appropriate action.

Additionally, the control 22 is generally configured to operate in the armed mode $M_A$ so as to generally instantaneously activate the one of more alarm devices 20 when the control 22 receives door signal $S_D$ prior to receiving the lock sensor signal $S_L$. Such a control configuration is preferred when the lock 14 is mechanical or purely electromechanical. However, in certain cases, the control 22 may be configured (i.e., programmed, hard-wired, etc.) so as to activate the alarm(s) 20 only upon expiration of a predetermined period of time after first receiving the door signal $S_D$ if not first "manually" disarmed. More specifically, in the latter case, the control 22 is configured to activate the alarm devices 20 upon expiration of the predetermined time period (e.g., 10 seconds) and to alternatively switch to the disarmed mode $M_D$ when the control 22 receives a predetermined input, e.g., a disarm code, prior to expiration of the time period. Such a control arrangement may be preferred for an electronic lock 14 having a mechanical "back-up" or override lock (not depicted) for use in the event of a failure of the primary electronic lock 14. Furthermore, the control 22 is configured to operate in the disarmed mode $M_D$ such that the alarm device 20 remains inactive even when the control 22 receives the door sensor signal $S_D$. In other words, when the control 22 is operating in the disarmed mode $M_D$, the control 22 preferably does not perform any function or take any action when receiving either or both of the door sensor signal $S_D$ or/and the lock signal $S_L$.

Preferably, the control 22 includes a microprocessor 24 coupleable with the door and lock sensors 16, 18, respectively, and coupled with the alarm device 20. The control 22 also preferably includes a wireless receiver 26 or "transceiver" coupled with the microprocessor 24 and configured to receive each one of the lock and door signals $S_L$, $S_D$ and to transmit each signal $S_L$, $S_D$ to the microprocessor 24 as electromagnetic waves or signals, most preferably as radio waves. However, the microprocessor 24 may be coupled with either or both sensors 16, 18 through electrical wires or cables (i.e., hard-wired). Further, the security system 12 preferably also comprises an input device 28 coupled with the control 22, specifically the preferred microprocessor 24, and configured to provide at least one predetermined input to the control 22 such that the control 22 "manually" switches (i.e., by user input) between the armed and disarmed modes $M_A$, $M_D$. The input device 28 may include a keypad (as depicted), a pushbutton, a touch screen, a card reader, a radio receiver, or any other appropriate device capable of providing an input to the control microprocessor 24. Furthermore, the control 22 is preferably provided by a commercially available security panel 30, and most preferably a Model PRO300 available from ADT Security Services of Boca Raton, Fla., which also provides the preferred input device 28, as depicted in FIG. 1.

Referring now to FIGS. 3-10, the lock 14 of the present lock assembly 10 may be constructed as a mechanical lock 32 (FIGS. 3-9), an electromechanical lock 34 (FIG. 11), an electromagnetic lock 36 (FIG. 12), or any other appropriate type of lock. With the mechanical and electromechanical locks 32, 34, respectively, the lock 14 preferably includes a moveable member 40 displaceable between a first position $P_1$ (FIG. 5) and second position $P_2$ (FIG. 6) when the lock 14 adjusts from the first, locked configuration to the second, unlocked configuration. The moveable member 40 may include a bolt 42, a latch 44, a spindle 46, a handle 48, a clutch member 50, or any other component of the lock 14 that displaces when the lock 14 is unlocked in an intended or authorized manner. Further, with mechanical locks 32 and electromechanical locks 34, the lock sensor 16 is preferably configured to sense displacement (i.e., linear, rotational, vibrational, etc.) of the moveable member 40, such displacement including any motion of the member 40, a specific amount of member displacement, displacement of the member 40 to a specific position, or any other appropriate movement indicating that the lock 14 is being unlocked in a correct, authorized manner.

Particularly with a mechanical lock 32, the lock sensor 16 preferably includes a motion detector or sensor 38 configured to generate an electrical signal, corresponding to the lock signal $S_L$, whenever the particular lock member 40 is moved or displaced. Preferably, the motion sensor 38 includes a reed switch 39 (FIGS. 5, 6 and 10) and a switch actuator 41 configured to cause the switch 39 to open or/and close, as described below, such that the sensor 38 merely detects movement of the appropriate lock member 40. Most preferably, the motion sensor 38 detects a movement of the lock member 40 to a particular angular or linear position that only occurs when the lock 14 is adjusted in an authorized manner to the unlocked configuration (e.g., FIG. 6), although the sensor 38 may be configured to detect any substantial movement of the member 40. Further, the motion sensor 38 may be provided by any appropriate device configured to detect displacement of the moveable lock member 40, such as for example, a potentiometer, a magnetic position sensor, a capacitive displacement sensor, a variable differential transducer, an infrared sensor, a light beam sensor, etc., and/or may be configured to detect a certain amount of displacement.

Figure 11:
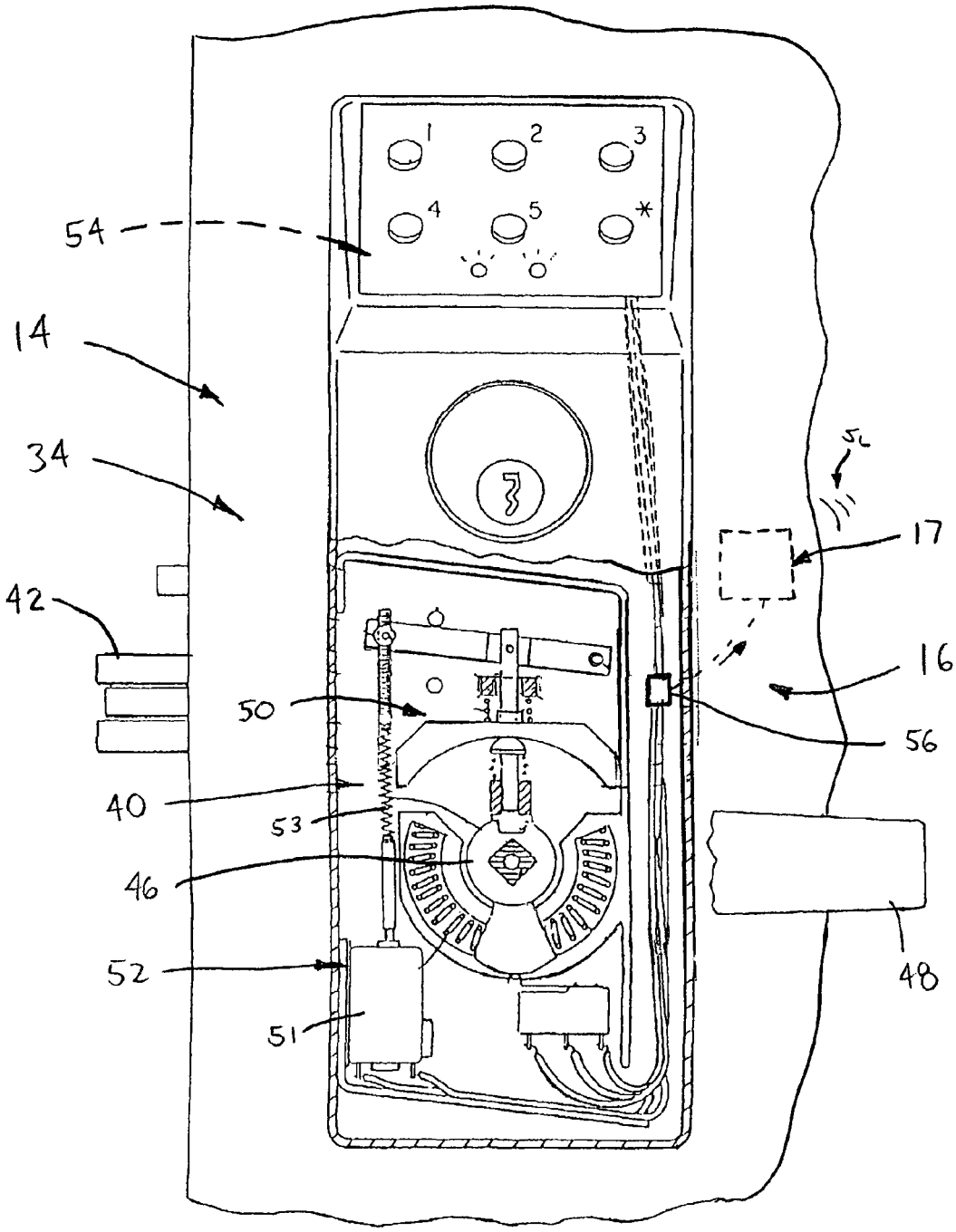
FIG. 11 is an elevational view of an electromechanical lock assembly.

Referring particularly to FIG. 11, with regard to an electromechanical lock 34, the lock 14 generally includes an actuator 52 and a controller 54. The actuator 52 is configured to displace at least a portion of a clutch 50, as discussed above, so as to adjust the lock 34 between the locked and unlocked configurations. The actuator 52 may be any appropriate type of displacement actuator, such as for example, a motor 51 operating a screw shaft 53 (as depicted), a gear train, a linkage mechanism, etc., connected with the moveable member 40, or a solenoid directly connected with the member 40 or through a mechanism (e.g., a pusher bar, a linkage, etc.). Further, the controller 54 is configured to operate the actuator 52 upon receipt of an authorized input, such as a "key" code, as discussed in further detail below.

With such an electromechanical lock 34, the lock sensor 16 may alternatively be configured to generate a signal when the lock controller 54 operates the actuator 52, as opposed to directly sensing movement of a particular lock member or component. Specifically, the lock sensor 16 for the electromechanical lock 34 may include a switch 56, such as a relay, electrically coupled with the actuator 52 or/and with the controller 54 that closes or opens when the actuator 52 is operated (i.e., provided with electrical power) so that a portion or component of the actuator rotates or displaces. When the switch 56 is shifted between open and closed states, an electrical signal is generated within the sensor 16 and is used to indicate an authorized operation of the actuator 52, and thus appropriate unlocking of the electromechanical lock 34. Furthermore, by generating the lock signal $S_L$ from an authorized operation of the lock actuator 52 (i.e., by receipt of the key code), such an electromechanical lock 34 has the additional benefit of avoiding a situation in which the control 22 is switched to the disarmed mode $M_D$ by forcing a lock 14 open, which could occur in certain lock structures when a motion sensor 38 is used to generate the lock sensor signal $S_L$.

Figure 12:
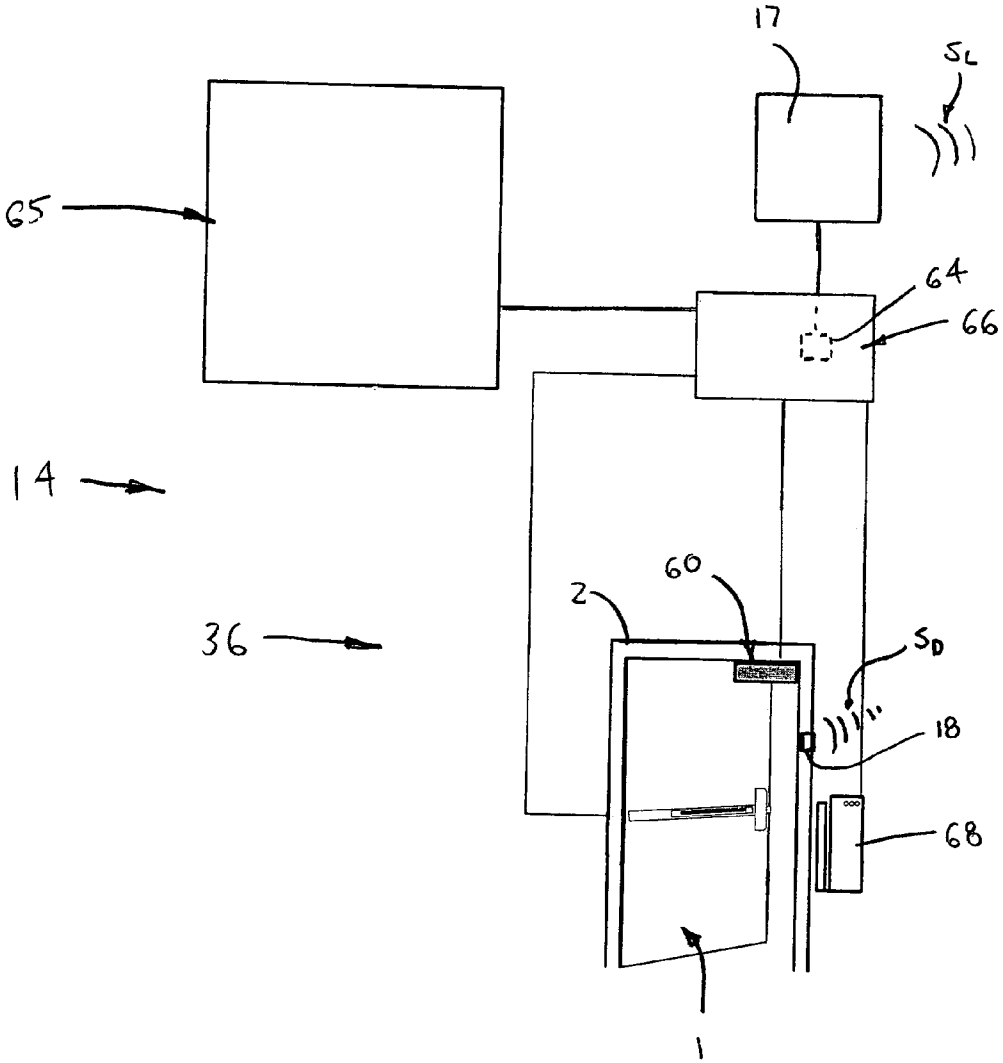
FIG. 12 is a more diagrammatic view of an electromagnetic lock assembly.

Referring now to FIG. 12, with an electromagnetic lock 36, the lock 14 preferably includes an electromagnet 60 adjustable between a powered state, at which the door 1 is magnetically secured to the frame 2, and an unpowered state at which the door 1 is displaceable with respect to the frame 2. In other words, the electromagnet 60, which may be mounted on the door 1 or to the frame 2, magnetically engages a metal plate (not shown) mounted on the other of the frame 2 and door 1 so as to releasably secure the door 1 within the frame 2. With such a lock 14, the lock sensor 16 is configured to sense when the electromagnet 60 adjusts from the powered state to the unpowered state; in other words, when electric power being supplied to the electromagnet 60 is "turned off".

Preferably, the lock sensor 16 for an electromagnetic lock 36 includes a switch 64, such as a relay, coupled with the magnet 60 (directly or through a power supply 65 coupled with the magnet 60) and configured to generate an electrical signal when the electromagnet 60 adjusts from the powered state to the unpowered state, thereby indicating an authorized unlocking of the electromagnetic lock 36. Most preferably, the electromagnetic lock 36 further includes a controller 66 coupled with the magnet 60 and the power supply 64 and an input device 68 coupled with the power supply 65. The controller 66, which preferably includes the switch 64, is configured to provide power to the magnet 60 when an authorized input is entered into the input device 68, at which point the switch 64 generates the lock signal $S_L$, as discussed above and in further detail below.

With each of the three constructions of the lock 14 described above, the lock sensor 16 preferably includes a wireless transmitter 17 electrically coupled with the motion sensor 38, the switch 56, or the switch 64. In each case, the transmitter 17 is configured to generate and transmit to the control 22 an electromagnetic signal corresponding to the lock sensor signal $S_L$ when the transmitter 17 receives the electrical signal from the motion sensor 38 or switches 56 or 64. Preferably, the transmitter 17 is a radio transmitter configured to generate and transmit a radio signal, but may alternatively generate and transmit any other appropriate type of electromagnetic signal, such as visible light, infrared, microwave, etc.

Figure 10:
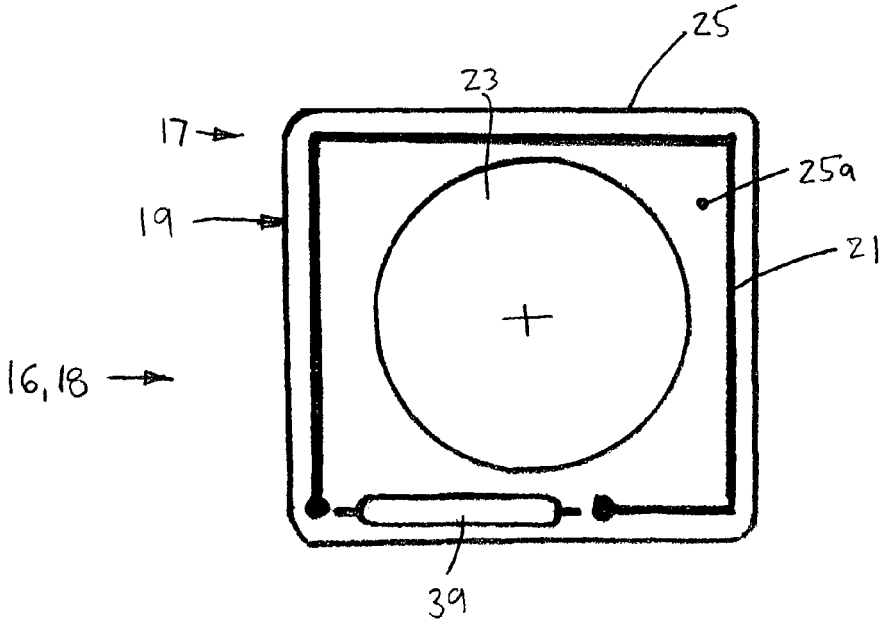
FIG. 10 is a more diagrammatic, plan view of a transmitter unit, shown without a housing cover.

Referring particularly to FIG. 10, the transmitter 17 is preferably provided by a transmitter unit 19 that includes the preferred reed switch 39, as described above, and further includes an antenna 21 coupled with the switch 39 and configured to transmit the lock signal $S_L$, and a power source, preferably a battery 23, electrically coupled with the switch 39 and antenna 21. A housing 25 has an interior chamber 25*a* for containing the switch 39, the antenna 21 and the battery 25 and is mountable to the door 1 generally proximal to the lock moveable member 40. Further, the reed switch 39 may be either normally open or normally closed, and adjustable to a closed position or an open position, respectively, by means of one or more magnets 108 (described below) of the actuator 41, to thereby cause the antenna 21 to transmit the lock signal $S_L$ to the control 22, as discussed in further detail below. Preferably, the transmitter unit 19 is a commercially available wireless transmitter, such as for example a Model 5814 "Ultra-Small Door/Window Transmitter" available from Ademco Group of Syosset, N.Y.

With the above transmitter unit 19, the transmitter 17 and a portion of the motion sensor 38 or the switches 56, 64 are provided by a single, integrated device. However, the sensor 38 or switches 56, 54 may be provided by a separate device(s) connected with the transmitter 17. For example, the motion sensor 38 may be formed as a cam (not shown) connected with a rotatable lock member 40 and a mechanical switch (not shown) electrically coupled with the transmitter 17. With this structure, rotation of the lock moveable member 40 causes the cam to close (or open) the switch to thereby generate the lock signal $S_L$, which is then transmitted by the connected transmitter 17. As a further alternative, the lock sensor 16 of a particular security system may be hard-wired to the control 22, in which case the sensor 16 does not include any type of transmitter. The scope of the present invention encompasses these and all other alternative constructions of the lock sensor 16 that permit the lock assembly 10 to function as generally described herein.

Referring specifically to FIG. 1, the door sensor 18 preferably includes a switch 70 and a wireless transmitter 72 electrically coupled with the switch 70. The switch 70 is configured to generate an electrical signal when the door 1 displaces with respect to the frame 2. Preferably, the switch 70 includes a reed switch 39 (FIG. 10) disposed on the door 1 or the frame 2 and a magnet (not depicted) disposed on the other one of the frame 2 and door 1. As such, movement of the door I with respect to the frame 2 results in relative movement between the switch 39 and magnet, causing the switch 39 to open or close and thereby generate the electrical signal. Further, the transmitter 72 is configured to transmit to the control 22 an electromagnetic signal corresponding to the door sensor signal $S_D$ when the transmitter 72 receives the switch signal (i.e., switch 39 opens or closes). As with the lock sensor 16, the door sensor 18 preferably includes a transmitter unit 19 that provides the reed switch 39, and also an antenna 21 coupled with the switch 39, a power source/battery 23, and a housing 25 containing the various transmitter elements and mountable on the door 1 or frame 2. Further, the door transmitter unit 19 is also preferably provided by a commercially available wireless transmitter, such as for example a Model 5814 "Ultra-Small Door/Window Transmitter" available from Ademco Group of Syosset, N.Y. Alternatively, as with the lock sensor 16, the door sensor 18 may be hard-wired to the control 22, in which case the sensor 18 does not include any type of transmitter.

Additionally, the one or more alarm devices 20 are each configured to provide an audible alarm, to provide a visual alarm, and/or to contact security personnel. Specifically, the alarm device 20 may include one or more sirens or speakers 27 configured to generate an audible alarm, one or more switches (not depicted) coupled with at least one light device 29 (e.g., interior or exterior lamp) and configured to activate the light device(s) (i.e., turn on lights in secured area), and/or a communication device 31, such as a phone dialer or modem, configured to contact security personnel (i.e., police or a monitoring service). However, the alarm device(s) 20 may have any appropriate construction and the scope of the present invention is no manner limited thereby.

With the structure described above, the security system 12 with the lock assembly 10 prevents false alarms that may occur if a user exits or enter through the door 1 when the control 22 is set to an "instant alarm" armed mode $M_A$, (discussed below), fails to exit through the door 1 prior to expiration of an "exit delay period", or in certain cases, fails to switch the control 22 to the disarmed mode $M_D$ within an "entrance delay period" after entry through the door 1. In other words, by providing the lock sensor signal $S_L$ to the control 22 when the lock 14 is opened in an authorized manner, the control 22 will shift to the disarmed mode $M_D$ rather than activate the alarm device(s) 20, and thus potentially eliminates the need to disarm the control 22 after unlocking a door 1 in an authorized manner (i.e., using key or appropriate credential).

Referring now to FIGS. 3-8, one presently preferred construction of a mechanical lock 32 includes a bolt 42, a spindle 46 operatively coupled with the bolt 42, and both a cylinder lock 94 (FIG. 4) and a thumbturn 104 (FIG. 3) each operatively connected with the spindle 46. In this preferred construction, the spindle 46 provides the moveable member 40 sensed by the lock sensor 16, as described in detail below. Further, the bolt 42 is slidably disposed within the door 1 and releasably engageable with a strike (not shown) on the frame 2 to secure the door 1 therewithin. As best shown in FIG. 9, the lock 32 preferably further includes a retractor linkage 43 having a drive link 45 connected with the spindle 46 and a connector link 47 with a first end 47*a* attached to the drive link 45 and a second end 47*b* attached to a rear portion 42*a* of the bolt 42. As such, rotation of the spindle 46 about a central axis 46*a* pivots the drive link 45 such that the connector link 47 alternatively pushes and pulls the bolt 42 to slidably displace between engaged and nonengaged positions, generally in the manner of a "crank-slider" mechanism. However, the mechanical lock 32 may alternatively include any other appropriate mechanism or linkage for displacing or "retracting" the bolt 42; for example, the lock 32 may have a retractor mechanism that only retracts the bolt or latch and a biasing member (e.g., spring) (neither shown) to displace the bolt/latch to the extended position.

Figure 7:
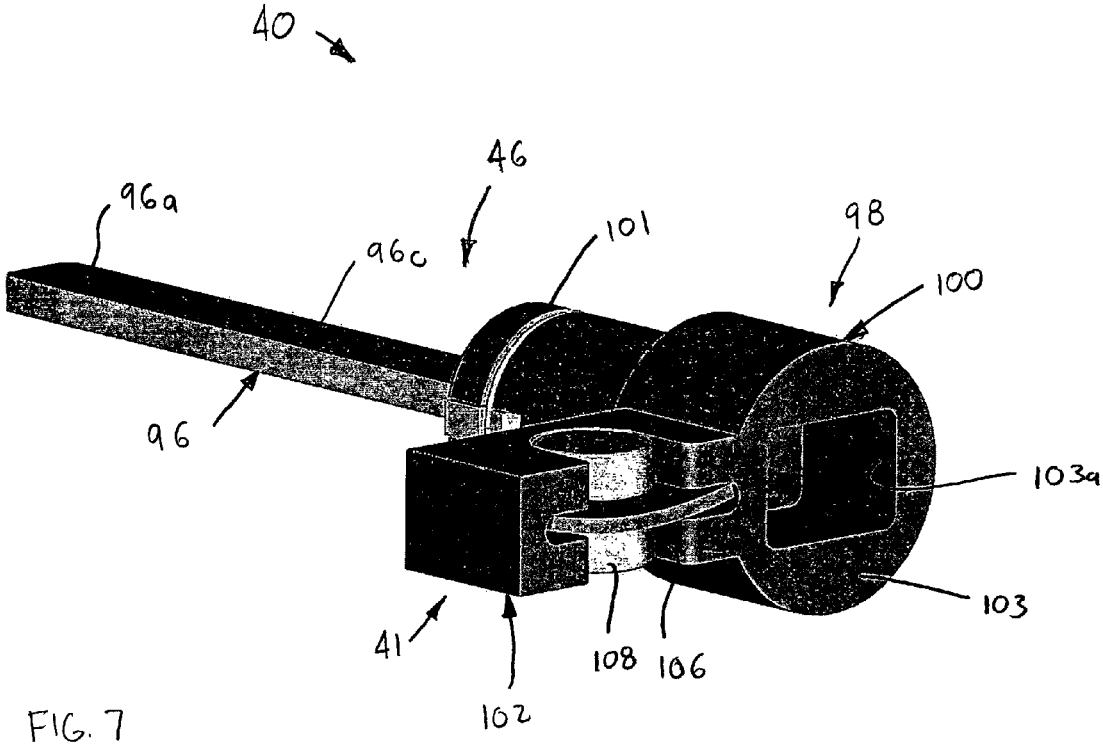
FIG. 7 is a perspective view of a spindle of the mechanical lock assembly of FIG. 5.
Figure 8:
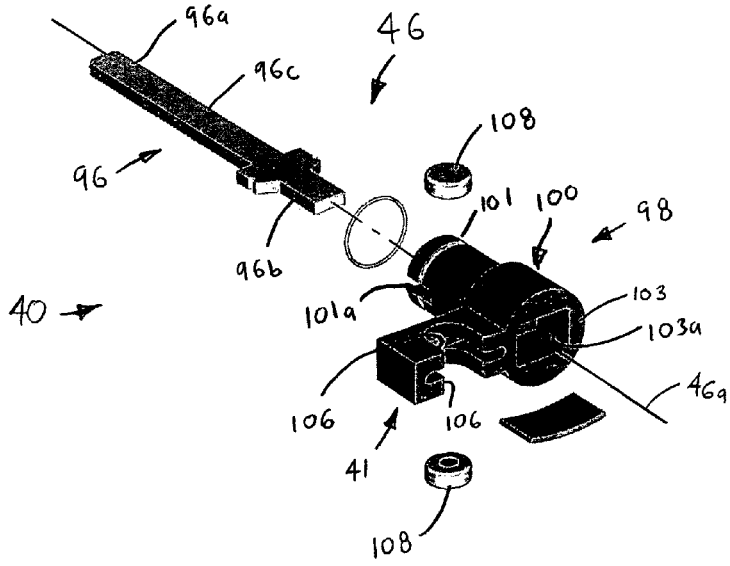
FIG. 8 is an exploded view of the spindle of FIG. 7.
Figure 9:
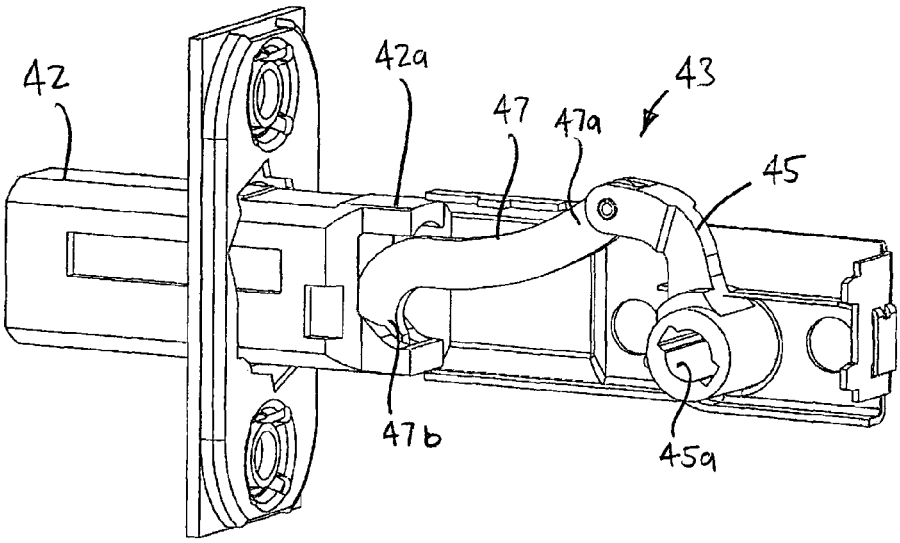
FIG. 9 is a perspective view of a retractor mechanism connected with the bolt.

As best shown in FIGS. 7 and 8, the spindle 46 preferably includes an elongated, generally rectangular actuator bar 96 extending through the drive link 45 of the retractor linkage 43 and a cylindrical hub 98 engageable with the lock sensor 16. The spindle bar 96 has a first end 96*a* engaged with the cylinder lock 94, a second, opposing end 96*b* connected with the hub 98 and a central portion 96*c* disposed within a slotted opening 45*a* of the retractor drive link 45. The hub 98 preferably has a main cylindrical body portion 100 and a sensor actuator support arm 102 extending laterally from the main body portion 100. The main body portion 100 has an inner end 101 with an slotted opening 101*a* for receiving the spindle bar second end 96*b* and an outer end 103 with a generally rectangular hole 103*a* for receiving a portion of a lock thumbturn 104, thereby operatively connecting the thumbturn 104 with the bolt 42. The actuator support arm 102 has a pair of openings 106 each configured to receive a separate magnet 108, the magnets 108 functioning to close and/or open the reed switch 39 of the preferred lock sensor 16. Specifically, at least one of the magnets 108 is disposeable generally proximal to, or alternatively moveable away from, the preferred lock sensor 16 when the spindle hub 98 is rotated so as to actuate the reed switch 39, as discussed above and in further detail below. Thus, the one or more magnets 108 and the moveable support arm 102 provide the switch actuator 41, as described above. Further, although two magnets 108 are preferred to provide the capability of assembling the spindle 46 in different orientations, only a single magnet 108 is required to actuate the reed switch 39.

By utilizing the spindle 46 as the moveable member 40 and having the lock sensor 16 disposed on the door 1, the lock assembly 10 of the present invention provides the advantage of avoiding an "unauthorized generation" of the lock sensor signal $S_L$ when the bolt 42 is forced or otherwise retracted out of the frame 2. Specifically, the lock 14 may be constructed such that the bolt 42 is displaceable while the spindle 46 remains stationary, such that lock sensor 16 does not generate the lock signal $S_L$ when the bolt 42 is forced out of the frame strike, in which case the control 22 activates the alarm 20 when the door 1 is subsequently opened. However, if the lock sensor 16 was disposed on the frame 2 and configured to sense movement of the bolt 42 relative to the strike (not shown), the lock signal $S_L$ would be generated (and the control 22 disarmed) when the bolt 42 is forced open. Additionally, by providing the lock sensor 16 as part of an assembly mountable onto the door 1, as described in further detail below, the lock sensor 16 is installed as a unit with the lock assembly 10. As such, installation of the preferred lock sensor 16 is clearly facilitated in comparison to a sensor 16 mounted to the frame 2, which may require additional drilling or other machining of the frame 2 in order to install the sensor 16 proximal to the strike.

Figure 5:
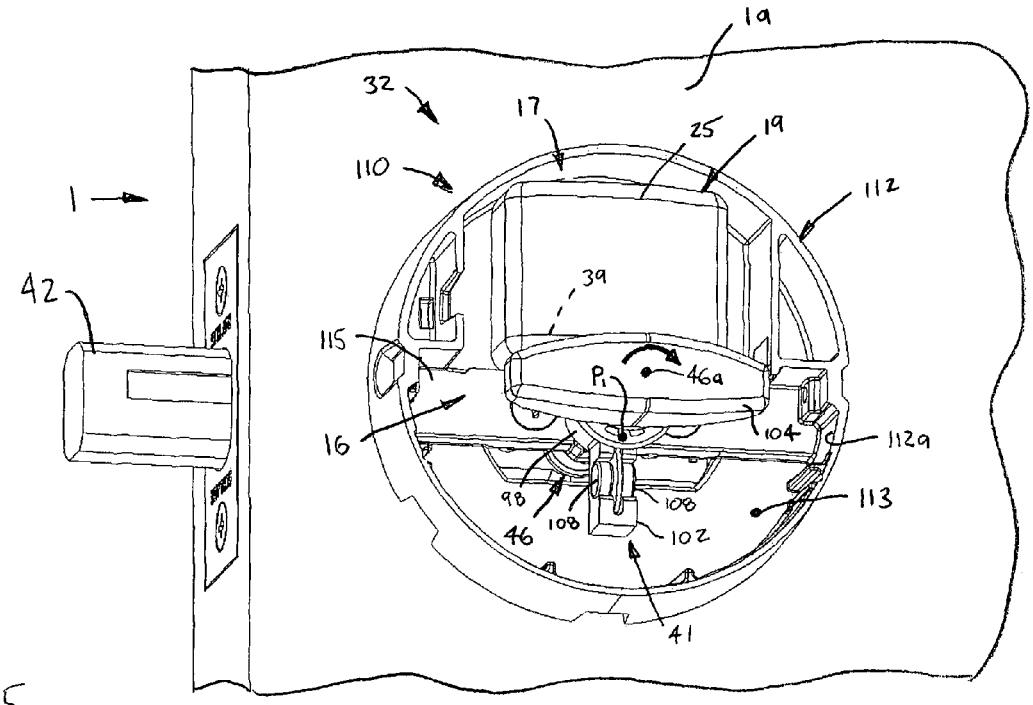
FIG. 5 is another perspective view of the lock assembly of FIG. 3 with an inner housing cover removed, showing a lock bolt in an extended position and a moveable lock member in a first position.
Figure 6:
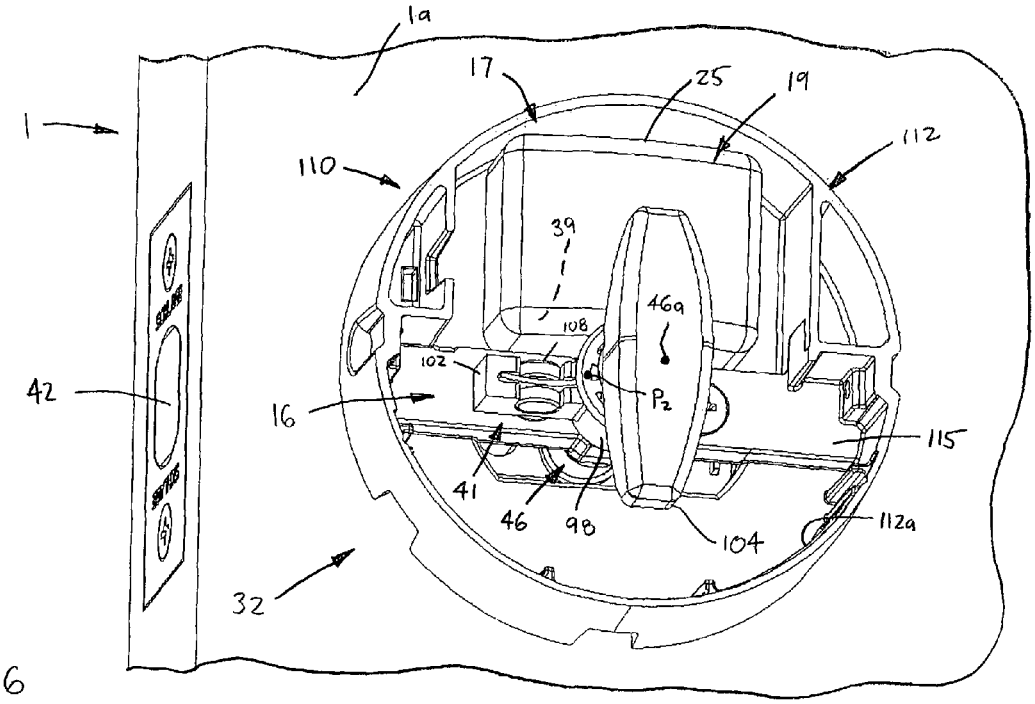
FIG. 6 is another view of the lock assembly of FIG. 5, showing the lock bolt in a retracted position and a moveable lock member in a second position.

Referring to FIGS. 5 and 6, the reed switch 39 of the lock sensor 16 is preferably configured as a normally-open switch and the spindle 46 is constructed and assembled such that the actuator support arm 112 is spaced from the reed switch 39 when the spindle 46 is located at the first position $P_1$ and the bolt 42 is located in the extended or "locked" position (see FIG. 5). Additionally, the arm 112 is disposed proximal to the reed switch 39 when the spindle 46 is located at the second position $P_2$, at which the spindle position the bolt 42 is disposed in the retracted or "unlocked" position (see FIG. 6). As such, when the bolt 42 is in the extended or locked position (FIG. 5), the spindle 46 may be rotated clockwise about the spindle axis 46*a* by means of either the cylinder lock 94 or thumbturn 104 to move the switch actuator magnet(s) 108 generally proximal to the reed switch 39, while the bolt 42 moves toward the unlocked, retracted position, as shown in FIG. 6. As such, the magnet(s) 108 close the switch 39 and cause the transmitter 17 to generate and transmit the lock sensor signal $S_L$ to the control 22. Alternatively, the spindle 46 may be constructed such that at least one magnet 108 is located proximal to the switch 39 when the bolt 42 is extended and to move the magnet(s) 108 away from the switch 39 as the bolt 42 is retracted, with the transmitter 17 configured to transmit the lock signal $S_L$ when the switch 39 is "opened". Further, the preferred reed switch 39 and switch actuator 41 coupled with the spindle 46 may be arranged in any appropriate configuration that enables the lock sensor 16 to generate the lock signal $S_L$ when the mechanical lock 32 is adjusted to the unlocked configuration, as discussed above.

Figure 3:
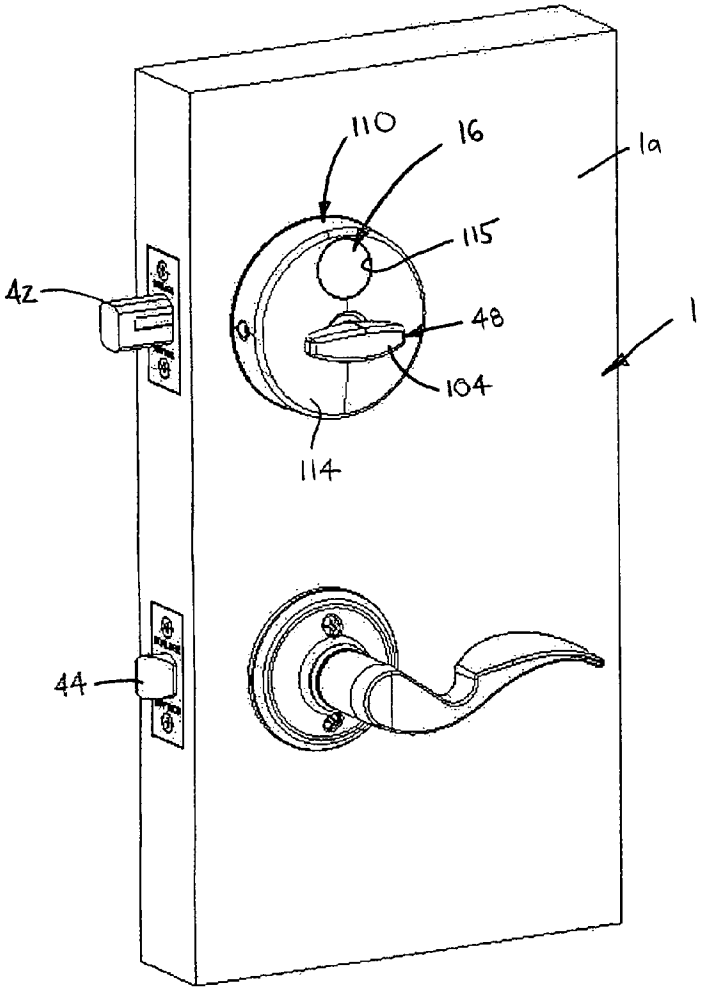
FIG. 3 is a perspective view of a mechanical lock assembly, showing the inside portion thereof.

Referring to FIGS. 3, 5 and 6, the lock 32 also preferably includes an inner housing 110 mountable to the door interior surface 1*a* and including a generally tubular base wall 112 providing an interior chamber 113, a generally cylindrical shell 114 disposeable about the base wall 112 to enclose the chamber 113, and a generally rectangular support member 115 disposed within and extending axially across the chamber 113. The support member 115 has a opposing ends integrally formed with the inner circumferential surface 112*a* of the base wall 112 and a central bearing opening (not shown) configured to rotatably support the spindle 46. Further, the transmitter unit 19 of the preferred lock sensor 16, as described above, is preferably mounted within the housing chamber 113 so as to be disposed generally proximal to, and preferably above, the spindle hub 98. Thus, the lock sensor 16 is installed on the door 1 when the inner housing 110 is mounted on the door inner surface 1*a*. Further, the housing shell 114 has a central bore (not indicated) configured to support the thumbturn 104 and a circular clearance hole 117 provided to avoid interference with transmission of electromagnetic waves from the lock sensor transmitter 17.

With the above-described structure, the exemplary mechanical lock 32 and lock sensor 16 basically functions in the following manner. When an authorized user desires to open the door 1, the user operates the cylinder lock 94 by means of a key (not shown), or rotates the thumbturn 104, such that the spindle bar 96 is rotated and drives the retractor 43 to retract the bolt 42. As the spindle bar 96 is rotated, the spindle hub 98 rotates within the housing 110 such that the actuator arm 102 preferably displaces toward the lock sensor 16 to position one of the magnets 108 proximal to the preferred reed switch 39, causing the switch 39 to close and generate an electrical signal. The lock sensor transmitter 17 then sends to the control 22 a radio signal corresponding to the lock sensor signal $S_L$. As such, the control 22 switches to the disarmed mode $M_D$ prior to displacement of the door 1, thereby preventing the control 22 from activating the alarm device 20 when subsequently receiving the door sensor signal $S_D$.

However, if the door 1 is forced open such that the door 1 displaces relative to the frame 2 without appropriate adjustment of the lock 32 to the unlocked configuration, the spindle 46 will not be displaced to the second position $P_2$, such that the reed switch 39 remains open or closed (as appropriate) and the lock sensor signal $S_L$ is not generated. Therefore, the control 22 only receives the door sensor signal $S_D$, such that the control 22 then activates the alarm device(s) 20 if the control 22 is operating in the armed mode $M_A$. Further, electromechanical locks 34 or electromagnetic locks 36 operate in a similar manner when the door 1 is opened without appropriate adjustment of the lock 14 to the unlocked configuration, and thus without first generating the lock signal $S_L$ to indicate an authorized access through the door 1.

The embodiments described above and illustrated in the figures are presented by way of example only and are not intended as a limitation upon the concepts and principles of the present invention. As such, it will be appreciated by one having ordinary skill in the art that this invention is not limited to the particular embodiments disclosed, and that various changes in the elements and their configuration and arrangement are possible without departing from the spirit and scope of the present invention as set forth in the appended claims

I claim:

1. A security system for monitoring at least one door, the door being movably disposed within a frame, the security system comprising:

a lock adjustable between a first configuration at which the lock secures the door within the frame and a second configuration at which the door is displaceable with respect to the frame;

a lock sensor configured to generate a signal when the lock adjusts from the first configuration to the second configuration;

a door sensor configured to generate a signal when the door displaces with respect to the frame;

an alarm device configured to provide an alarm; and a control coupleable with the lock sensor and with the door sensor, switchable between an armed mode and a disarmed mode, and configured to operate in the armed mode such that the control activates the alarm device when the control receives the door sensor signal prior to a receipt of the lock sensor signal and alternatively switches to the disarmed mode when the control receives the lock sensor signal prior to a receipt of the door sensor signal.

2. The security system as recited in claim 1 wherein the control is configured to operate in the disarmed mode such that the alarm device remains inactive when the control unit receives the door sensor signal.

3. The security system as recited in claim 1 wherein: the lock includes a moveable member displaceable between first and second positions when the lock adjusts from the first configuration to the second configuration; and the lock sensor is disposed on the door and is configured to sense displacement of the moveable member.

4. The security system as recited in claim 3 wherein the moveable member includes at least one of a bolt, a latch, a spindle, a handle and a clutch member.

5. The security system as recited in claim 3 wherein the lock sensor includes: a motion sensor configured to generate an electrical signal when the moveable member displaces; and a transmitter electrically coupled with the motion sensor and configured to generate and transmit an electromagnetic signal corresponding to the lock sensor signal when the transmitter receives the motion sensor electrical signal.

6. The security system as recited in claim 5 wherein the motion sensor includes one of a switch, a potentiometer, magnetic position sensor, a capacitive displacement sensor, a variable differential transducer, an infrared sensor, and a light beam sensor.

7. The security system as recited in claim 3 wherein: the moveable member includes a bolt slidably disposed within the door and displaceable between an extended position in which the bolt is engaged with the frame and a retracted position in which the bolt is nonengaged with the frame; and the lock sensor includes a switch disposed on the door and adjustable between open and closed configurations when the bolt displaces between the extended and retracted positions and a transmitter disposed on the door, coupled with the switch, and configured to transmit an electromagnetic signal corresponding to the lock signal when the switch is adjusted between the open and closed configurations.

8. The security system as recited in claim 1 wherein: the lock includes a moveable member displaceable between first and second positions when the lock adjusts from the first configuration to the second configuration, an actuator configured to displace the moveable member between the first and second positions, and a controller configured to operate the actuator; and the lock sensor is disposed on the door and is configured to generate a signal when the lock controller operates the actuator.

9. The security system as recited in claim 8 wherein the lock sensor includes: a relay electrically coupled with at least one of the lock controller and the actuator and configured to generate an electrical signal when the controller operates the actuator; and a wireless transmitter electrically coupled with the relay and configured to generate and transmit an electromagnetic signal corresponding to the lock sensor signal when transmitter receives the relay electrical signal.

10. The security system as recited in claim 8 wherein: the lock moveable member includes one of a bolt, a latch, a spindle, a handle and a clutch member; and the actuator includes one of an electric motor and a solenoid.

11. The security system as recited in claim 1 wherein: the lock includes an electromagnet adjustable between a powered state at which the door is magnetically secured to the frame and an unpowered state at which the door is displaceable with respect to the frame; and the lock sensor is configured to sense when the electromagnet adjusts from the powered state to an unpowered state.

12. The security system as recited in claim 11 wherein the lock sensor includes: a switch electrically coupled with the magnet and configured to generate an electrical signal when the electromagnet adjusts from the powered state to the unpowered state; and a transmitter electrically coupled with the switch and configured to transmit an electromagnetic signal corresponding to the lock sensor signal when the transmitter receives the switch signal.

13. The security system as recited in claim 1 wherein the door sensor includes: a switch configured to generate an electrical signal when the door displaces with respect to the frame; and a transmitter electrically coupled with the switch and configured to transmit to the control an electromagnetic signal corresponding to the lock sensor signal when the transmitter receives the switch signal.

14. The security system as recited in claim 1 further comprising: a wireless transmitter coupled with the lock sensor and configured to receive the lock sensor signal and to generate and transmit an electromagnetic signal corresponding to the lock signal; and a wireless receiver coupled with the control and configured to receive the lock electromagnetic signal, to generate an electrical signal corresponding to the lock sensor signal, and to transmit the electrical signal to the control.

15. The security system as recited in claim 1 wherein the alarm device includes at least one of: a siren configured to generate an audible alarm; a switch coupled with at least one light device and configured to activate the light device; and a communication device configured to contact security personnel.

16. The security system as recited in claim 1 wherein the control includes: a microprocessor coupleable with the door and lock sensors and coupled with the alarm device;

and a receiver coupled with the microprocessor and configured to receive each one of the lock and door signals and to transmit each signal to the microprocessor.

17. The lock assembly as recited in claim 1 wherein the lock sensor includes a wireless transmitter configured to transmit an electromagnetic signal to the control.

18. The security system as recited in claim 1 wherein: the lock includes a moveable member displaceable between first and second positions when the lock adjusts from the first configuration to the second configuration; and the lock sensor is configured to sense displacement of the moveable member.

19. The security system as recited in claim 1 wherein: the lock includes a moveable member displaceable between first and second positions when the lock adjusts from the first configuration to the second configuration, an actuator configured to displace the moveable member between the first and second positions, and a controller configured to operate the actuator; and the lock sensor is configured to generate a signal when the lock controller operates the actuator.

* * * * *